US008475345B2

(12) United States Patent
Wang

(10) Patent No.: US 8,475,345 B2
(45) Date of Patent: Jul. 2, 2013

(54) EXERCISE-CORD ANCHORED DEVICE

(76) Inventor: Wen-Ching Wang, Taichung (TW)

( * ) Notice: Subject to any disclaimer, the term of this patent is extended or adjusted under 35 U.S.C. 154(b) by 318 days.

(21) Appl. No.: 13/020,527

(22) Filed: Feb. 3, 2011

(65) Prior Publication Data

US 2012/0202657 A1 Aug. 9, 2012

(51) Int. Cl.
*A63B 21/055* (2006.01)

(52) U.S. Cl.
USPC ..... 482/122; 482/125; 482/126; 482/139; 403/348

(58) Field of Classification Search
USPC ..... 482/82, 91, 92, 121–126, 129, 130, 482/139, 148, 44, 47, 48; 403/348, 349
See application file for complete search history.

(56) References Cited

U.S. PATENT DOCUMENTS

| | | | | |
|---|---|---|---|---|
| 1,194,793 | A * | 8/1916 | Styers | 285/376 |
| 1,199,690 | A * | 9/1916 | Gillan | 24/581.1 |
| 4,518,162 | A * | 5/1985 | Oates | 482/93 |
| 5,094,464 | A * | 3/1992 | Musacchia, Sr. | 473/582 |
| 5,665,040 | A * | 9/1997 | Ho | 482/126 |
| 5,816,985 | A * | 10/1998 | Ho | 482/140 |
| 6,612,534 | B2 * | 9/2003 | Hennessey | 248/519 |
| 6,922,936 | B2 * | 8/2005 | Markley et al. | 43/18.1 CT |
| 7,886,756 | B2 * | 2/2011 | Chen | 135/25.4 |
| 8,069,539 | B2 * | 12/2011 | Joubert et al. | 24/265 H |
| 8,197,155 | B2 * | 6/2012 | Noh | 403/348 |
| 2005/0113218 | A1 * | 5/2005 | Sewitch et al. | 482/99 |
| 2006/0276309 | A1 * | 12/2006 | Ko | 482/91 |
| 2009/0253562 | A1 * | 10/2009 | Yang | 482/126 |

FOREIGN PATENT DOCUMENTS

CN 202128851 U * 2/2012

* cited by examiner

*Primary Examiner* — Loan Thanh
*Assistant Examiner* — Victor K Hwang
(74) *Attorney, Agent, or Firm* — Banner & Witcoff, Ltd.

(57) ABSTRACT

An exercise-cord anchored device is used to detachably secure an anchoring end of an elastic cord, and includes an anchored mount, a biasing member, and a tubular insert. The anchored mount has an inner tubular wall defining an insert opening and having an inserting route, a seat, and a rest wall. The biasing member is disposed in the insert opening. The tubular insert is coupled to the elastic cord, is insertable into the insert opening and is manually movable against the biasing force of the biasing member, and has a protuberance configured to be guided along the inserting route. When the mounting end is pushed manually to permit the protuberance to extend beyond the seat, the protuberance is turned angularly over the seat so as to abut against the rest wall, thereby retaining the tubular insert to the anchored mount.

10 Claims, 14 Drawing Sheets

EXERCISE-CORD ANCHORED DEVICE

BACKGROUND OF THE INVENTION

1. Field of the Invention

This invention relates to a cord exerciser, more particularly to an exercise-cord anchored device for securing to an elastic cord of the cord exerciser.

2. Description of the Related Art

U.S. Pat. No. 6,923,750B1 discloses an exercise-cord anchored device comprising a handgrip that is formed with a slot for insertion of an elastic cord therein. When it is desired to replace the elastic cord, the elastic cord is pulled out of the slot. However, the configuration of such a handgrip has a relatively weak engaging strength between the slot and the elastic cord. Therefore, the elastic cord maybe easily pulled out of the slot during use.

SUMMARY OF THE INVENTION

An object of the present invention is to provide a exercise-cord anchored device which permits ease of connection and detachment of an elastic cord and which can secure the elastic cord firmly.

According to this invention, the exercise-cord anchored device includes an anchored mount having upper and lower surfaces, an inner tubular wall which extends from the lower surface along an axis toward the upper surface to define an inset opening, an inserting route which is disposed on the inner tubular wall and which extends from the lower surface toward the upper surface, a seat which is disposed on the inner tubular wall and behind the inserting route in a clockwise direction, and a rest wall which is disposed on the inner tubular wall and behind the seat in the clockwise direction, and which disposed inwardly from the seat relative to the upper surface so as to cooperate with the seat to define a concavity. A biasing member is disposed in the insert opening and has a connected end secured relative to the upper surface, and an urging end disposed to exert a biasing force toward the lower surface. A tubular insert is adapted to couple with an anchoring end of an elastic cord, and has a mounting end configured to be insertable into the insert opening to be biased by the biasing force of the biasing member, and a protuberance disposed on the mounting end and configured such that, by virtue of guiding the protuberance along the inserting route, the mounting end is pushed manually against the biasing force of the biasing member, and such that, once the protuberance is brought to extend beyond the seat, the protuberance is turned angularly over the seat so as to be snapped into the concavity, thereby abutting against the rest wall.

BRIEF DESCRIPTION OF THE DRAWINGS

Other features and advantages of the present invention will become apparent in the following detailed description of the preferred embodiments of the invention, with reference to the accompanying drawings, in which.

DETAILED DESCRIPTION OF THE PREFERRED EMBODIMENTS

Figure 1:
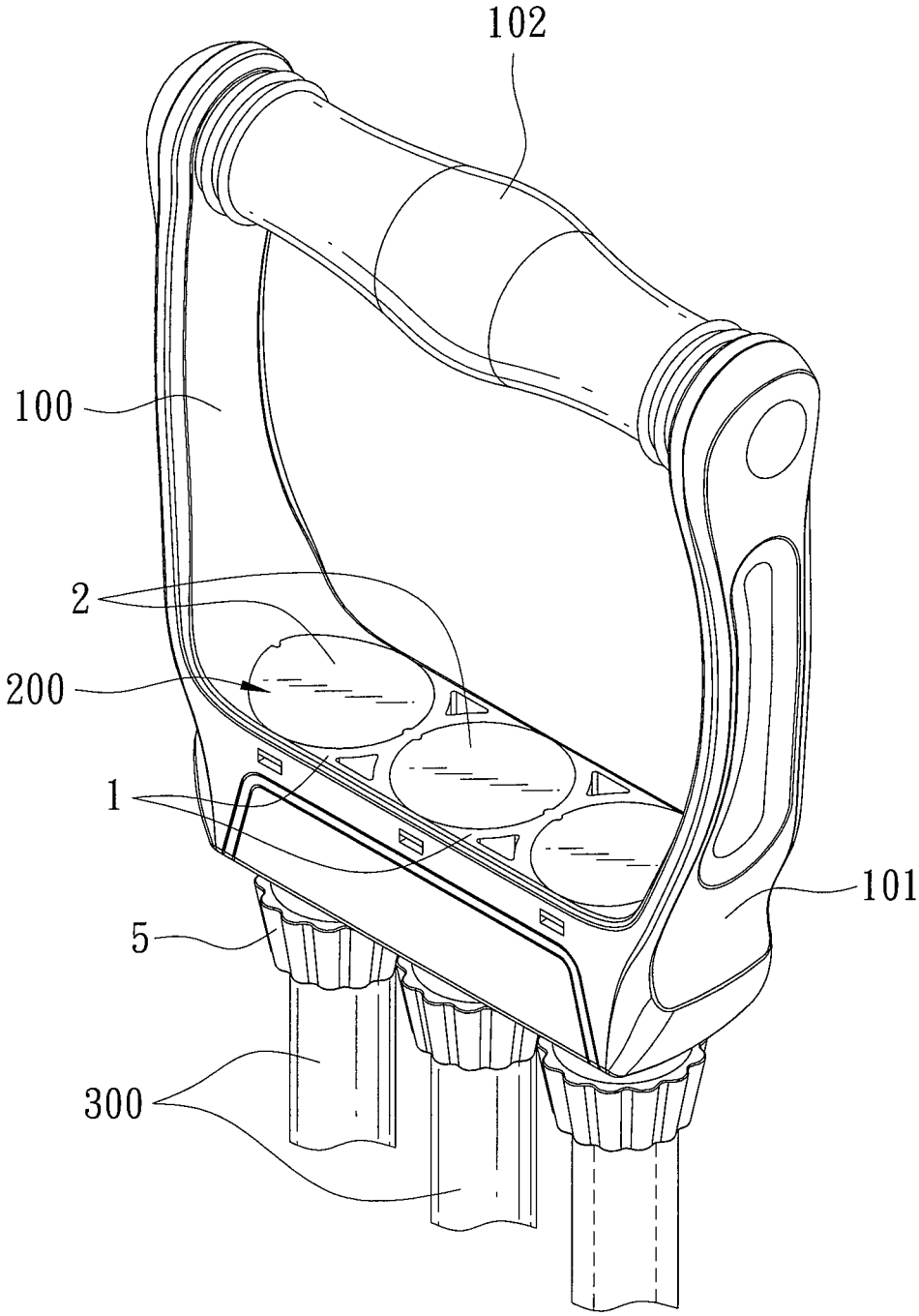
FIG. 1 is a perspective view of an exercise-cord anchored device of a first preferred embodiment according to the present invention.

Before the present invention is described in greater detail, it should be noted that same reference numerals have been used to denote like elements throughout the specification.

Figure 2:
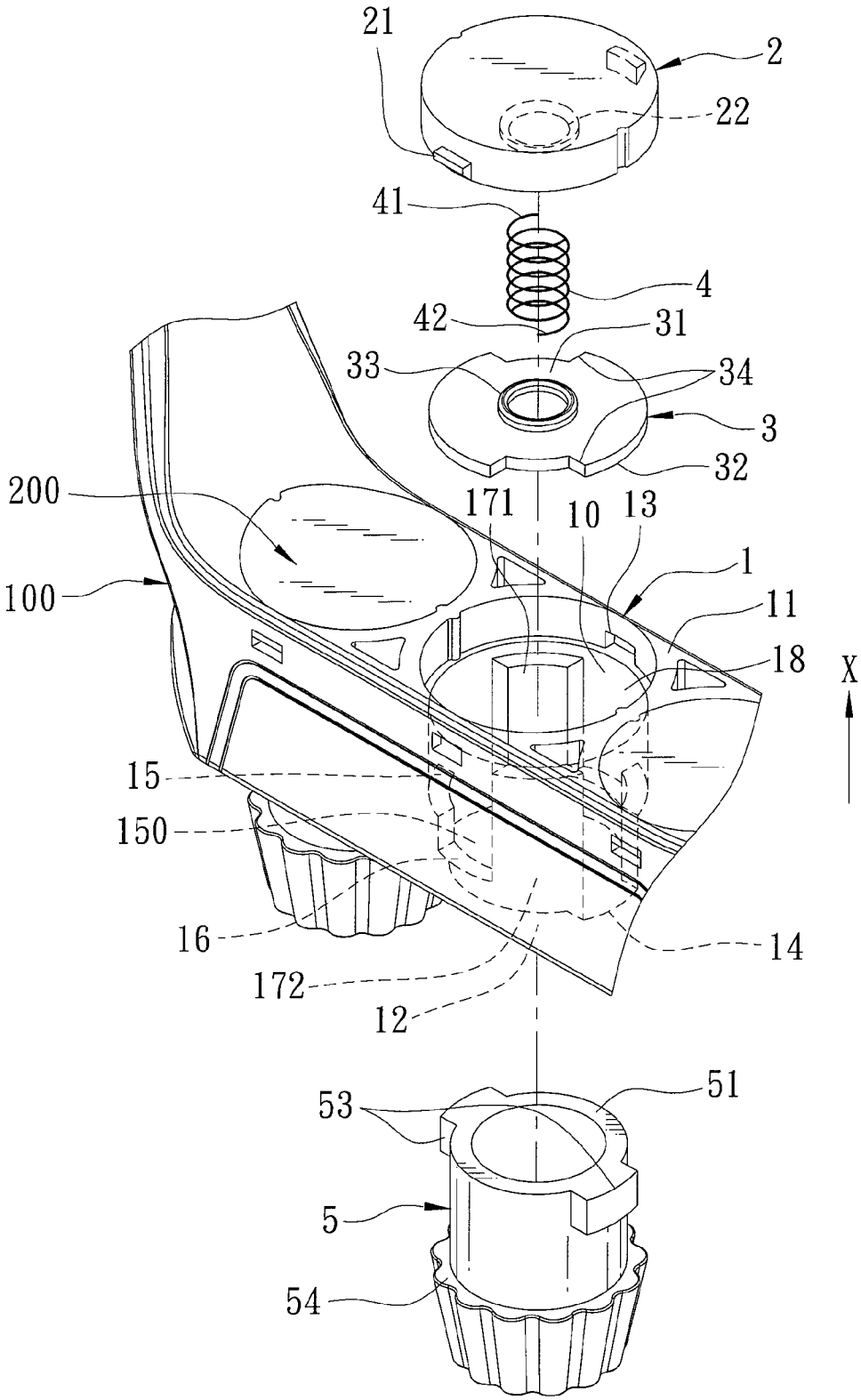
FIG. 2 is an exploded perspective view of the first preferred embodiment.

As shown in FIGS. 1 and 2, a first preferred embodiment of an exercise-cord anchored device 200 according to the present invention is adapted for detachably securing thereto a plurality of hollow elastic cords 300. The exercise-cord anchored device 200 comprises a plurality of anchored mounts 1, a plurality of end caps 2, a plurality of abutment members 3, a plurality of biasing members 4, a plurality of tubular inserts 5, and a grasp member 100.

The grasp member 100 has a mounting portion 101 disposed for mounting the anchored mounts 1 thereto and a grasp portion 102 disposed to be spaced apart from the anchored mounts 1 in a lengthwise direction (X) and accessible for operation by a user. In this embodiment, the number of the anchored mounts 1, the end caps 2, the abutment members 3, the biasing members 4, and the tubular inserts 5 is three. Since each of the structures of the anchored mounts 1, the end caps 2, the abutment members 3, the biasing members 4, and the tubular inserts 5 is substantially the same, in the following description, only one of the anchored mounts 1, one of the end caps 2, one of the abutment members 3, one of the biasing members 4, and one of the tubular inserts 5 will be described for the sake of brevity.

Figure 3:
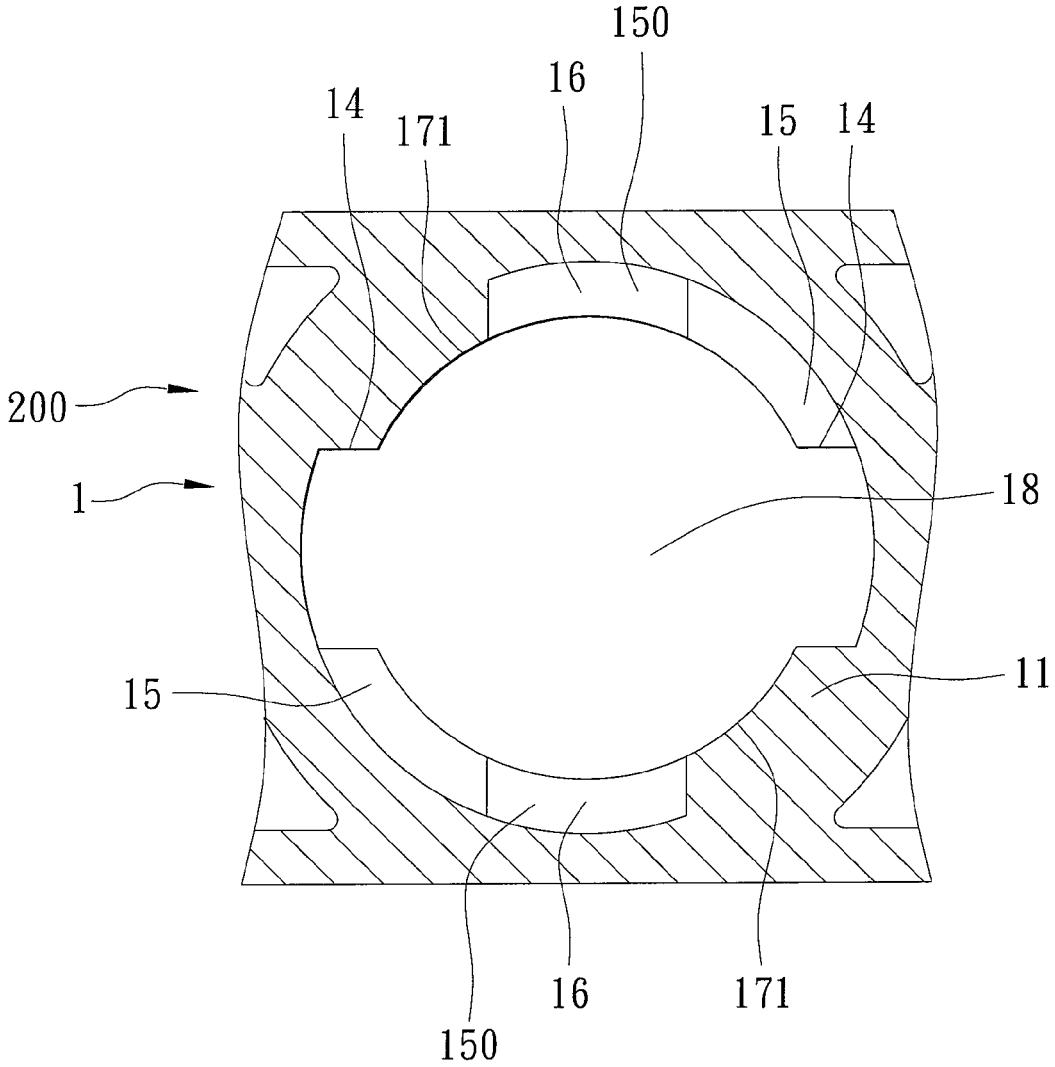
FIG. 3 is a fragmentary sectional top view of an anchored mount of the first preferred embodiment.
Figure 4:
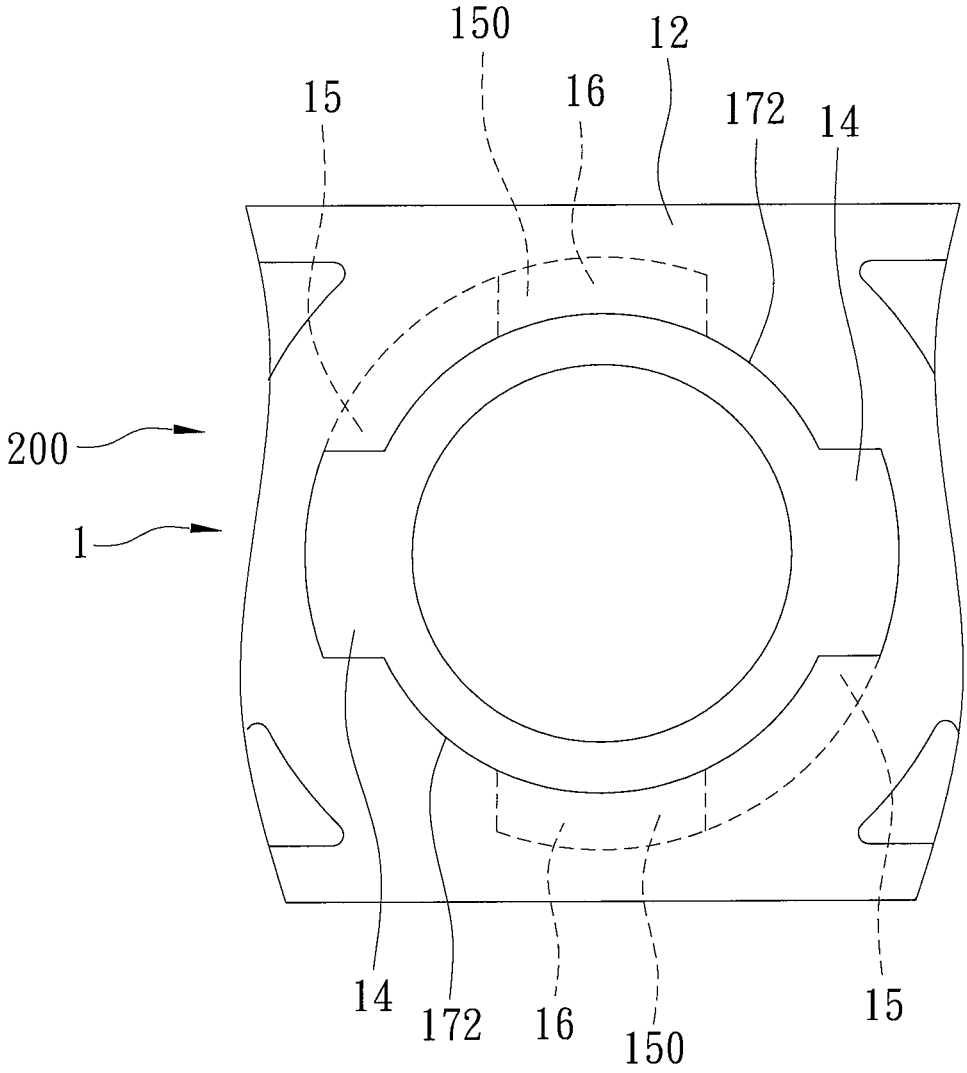
FIG. 4 is a fragmentary bottom view of the anchored mount of the first preferred embodiment.

Further referring to FIGS. 3 and 4, the anchored mount 1 has upper and lower surfaces 11, 12 opposite to each other in the lengthwise direction (X), an inner tubular wall 10 extending from the lower surface 12 along an axis oriented in the lengthwise direction (X) toward the upper surface 11 and defining an insert opening 18 that extends through the upper and lower surfaces 11, 12, a pair of notches 13 formed in the inner tubular wall 10 adjacent to the upper surface 11, a pair of diametrically opposite inserting routes 14 respectively disposed on the inner tubular wall 10 and extending in the lengthwise direction (X) from the lower surface 12 toward the upper surface 11, a pair of diametrically opposite seats 15 each disposed on the inner tubular wall 10 and behind a respective one of the inserting routes 14 in a clockwise direction (taken from an angle of FIG. 4), and a pair of rest walls 16 each disposed on the inner tubular wall 10 and behind a respective one of the seats 15 in the clockwise direction, and disposed inwardly from the corresponding seat 15 relative to the upper surface 11 so as to cooperate with the corresponding seat 15 to define a concavity 150. It should be noted that, one or more anchored mounts 1 may be alternatively mounted to the mounting portion 101 of the grasp member 100 in other embodiments of this invention.

The anchored mount 1 further has a pair of diametrically opposite guideways 171 each disposed on the inner tubular wall 10 and extending in the lengthwise direction (X), and a pair of diametrically opposite barrier walls 172 each disposed on the inner tubular wall 10 and extending from the lower surface 12 toward the guideway 171 behind a respective one of the rest walls 16 in the clockwise direction.

The end cap 2 is disposed to be engaged with the upper surface 11 to cover the insert opening 18, and has a positioning protuberance 22 formed on a bottom surface of the end cap 2 and a pair of projections 21 disposed outwardly and radially of its periphery for engaging respectively the notches 13 to be retainingly engaged with the anchored mount 1. The biasing member 4, in this embodiment, is a compression spring which is disposed in the insert opening 18, and which has a connected end 41 engaging the positioning protuberance 22 of the end cap 2 so as to be secured relative to the upper surface 11, and an urging end 42 disposed to be movable between a partially extended position, where the urging end 42 is closer to the upper surface 11, and a fully extended position, where the urging end 42 is biased against the seats 15 with a biasing force.

Figure 5:
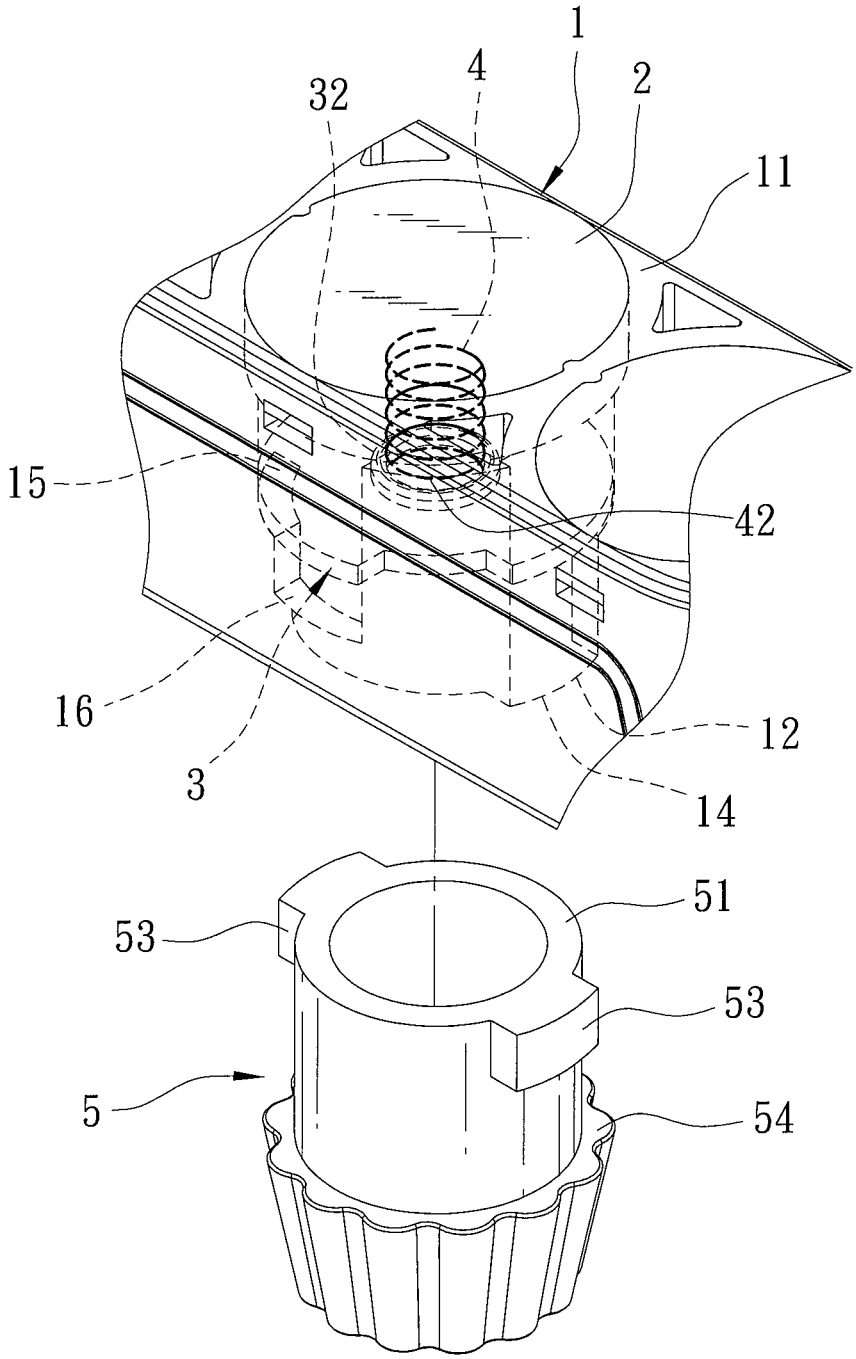
FIG. 5 is a fragmentary perspective view of the anchored mount and a tubular insert of the first preferred embodiment, illustrating the tubular insert detached from the anchored mount.
Figure 6:
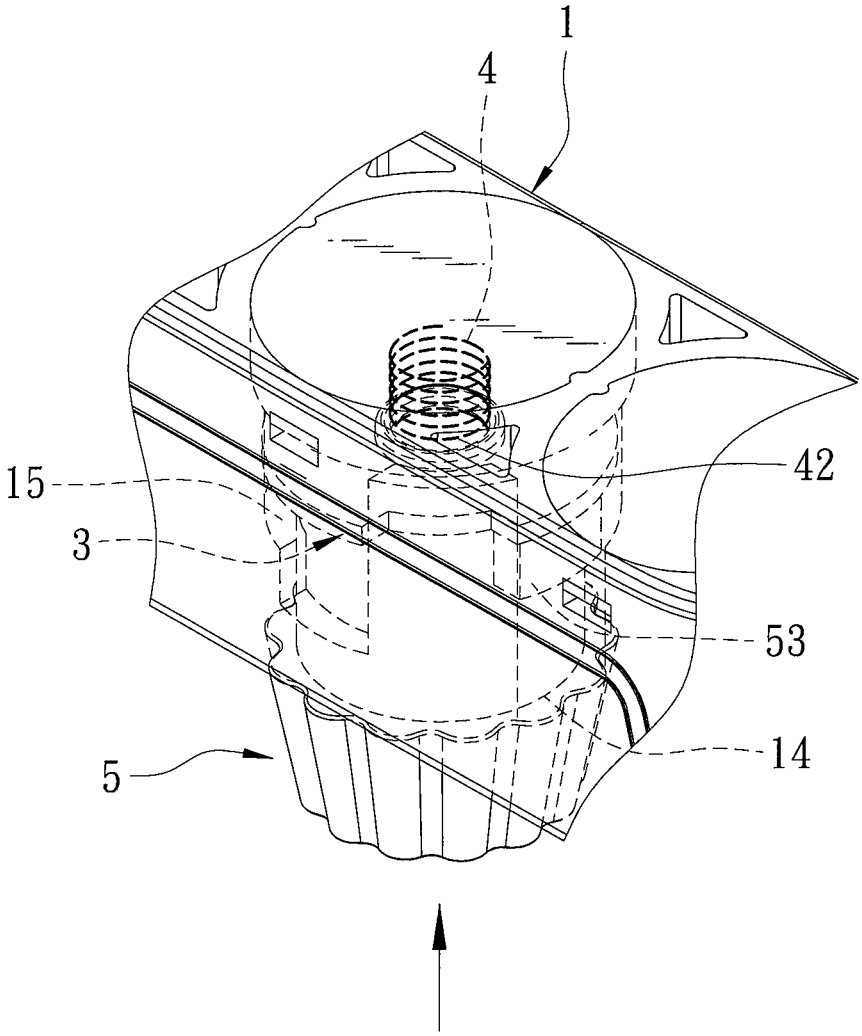
FIG. 6 is a fragmentary perspective view of the first preferred embodiment, illustrating the tubular insert inserted into the anchored mount.
Figure 7:
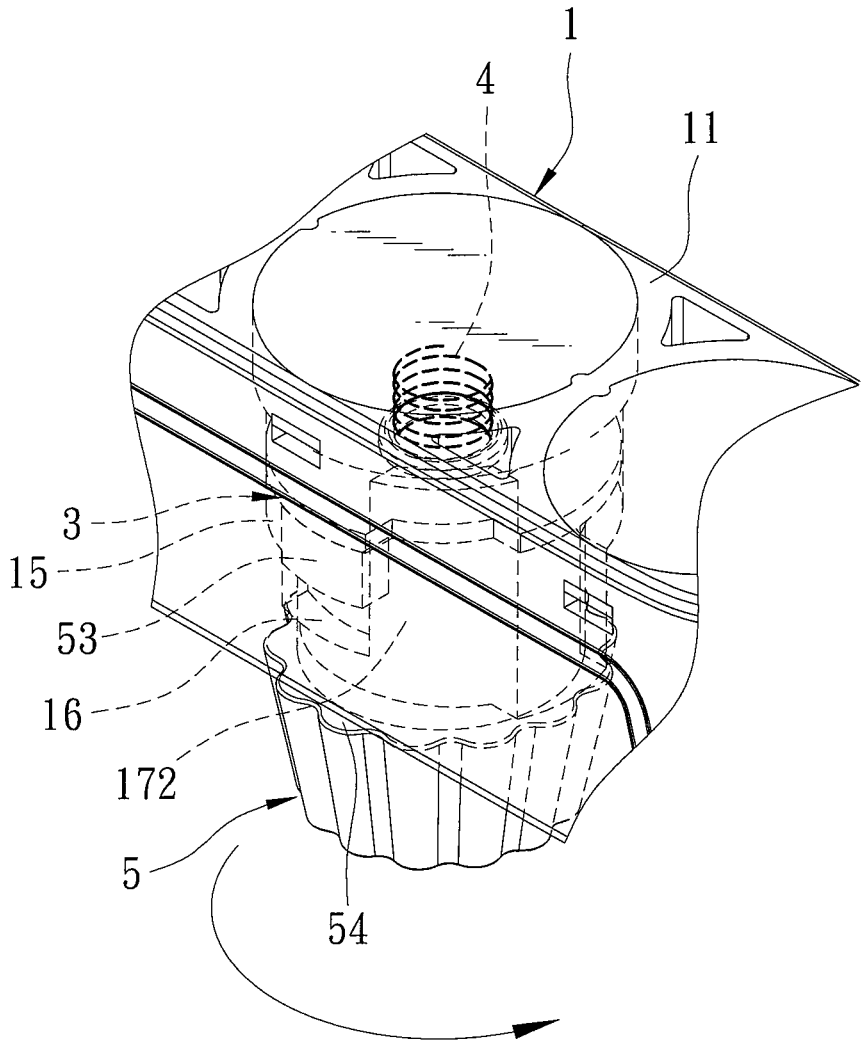
FIG. 7 is a fragmentary perspective view of the first preferred embodiment, illustrating the tubular insert turned angularly over the anchored mount.
Figure 8:
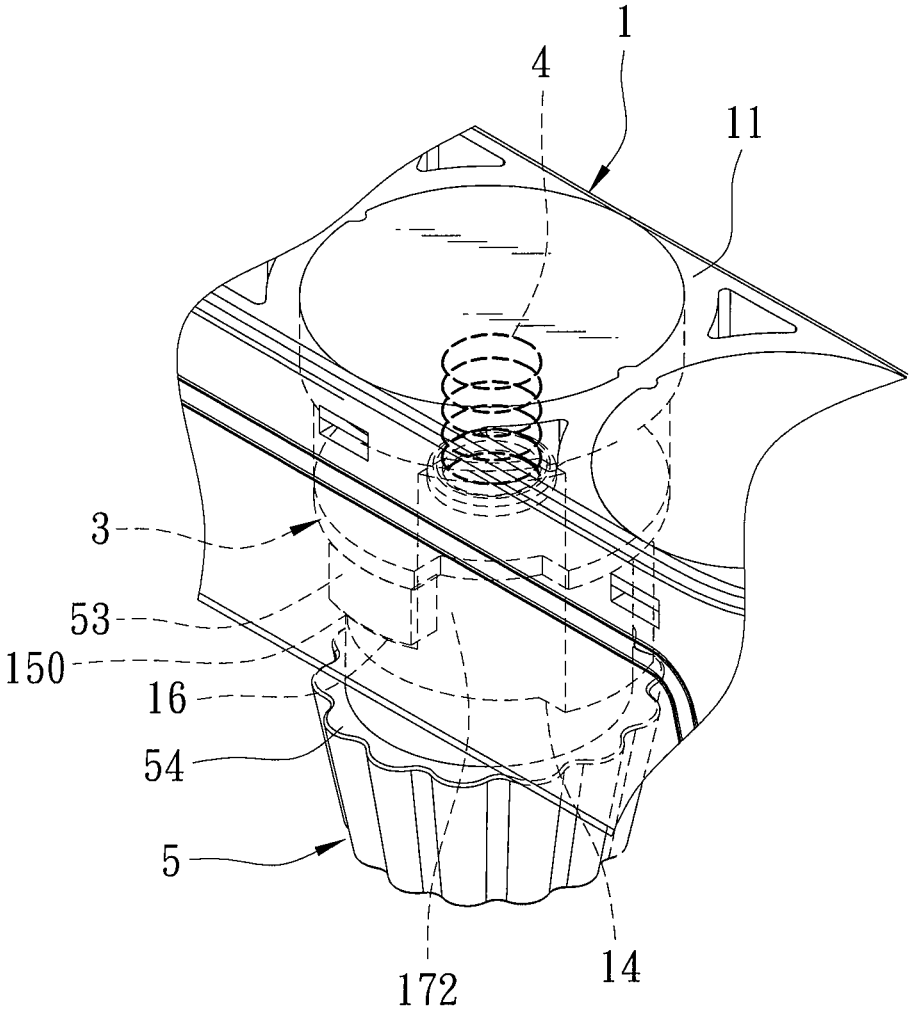
FIG. 8 is a fragmentary perspective view of the first preferred embodiment, illustrating a pair of protuberances snapped into concavities of the anchored mount.

Further referring to FIGS. 6 to 8, the abutment member 3 is in the form of a disk, and is disposed in and movable relative to the insert opening 18 in the lengthwise direction (X) via the upper surface 11 between proximate and distal positions (see FIGS. 5 and 6) relative to the lower surface 12 that correspond to the fully and partially extended positions of the urging end 42 of the biasing member 4, respectively. Specifically, the abutment member 3 has opposite urged and press surfaces 31, 32, a positioning protrusion 33 formed on the urged surface 31 for engaging the urging end 42 of the biasing member 4, and a pair of diametrically opposite notch portions 34. The urged surface 31 is biased by the urging end 42 of the biasing member 4 to bring the press surface 32 into pressing engagement with the seats 15 in the proximate position. Each of the notch portions 34 is formed along a periphery of the abutment member 3 and extends through the urged and press surfaces 31, 32 such that the abutment member 3 is guided by the guideway 171 of the anchored mount 1 to be non-rotatably displaced between the proximate and distal positions.

The tubular insert 5 is adapted to couple with an anchoring end of the elastic cord 300 (see FIG. 1) and has a mounting end 51 and a flange 54. The flange 54 is spaced apart from the mounting end 51 in the lengthwise direction (X) and has an outer diameter larger than that of the inner tubular wall 10. A pair of diametrically opposite protuberances 53 are disposed on the mounting end 51. By virtue of guiding the protuberances 53 along the inserting routes 14, the mounting end 51 is insertable into the insert opening 18 via the lower surface 12. The tubular insert 5 is pushed manually toward the upper surface 11 of the anchored mount 1 against the biasing force of the biasing member 4 through the abutment member 3 so as to displace the urging end 42 of the biasing member 4 from the fully extended position (see FIG. 5) to the partially extended position (see FIG. 6) and to displace the abutment member 3 from the proximate position to the distal position. The protuberances 53 are brought to extend beyond the seats 15 (see FIG. 6) until the flange 54 abuts against the lower surface 12. Subsequently, each of the protuberances 53 is turned angularly over a respective one of the seats 15 about the axis (see FIG. 7) so as to be snapped into the respective concavity 150 (see FIG. 8), thereby abutting against the corresponding rest wall 16. In the meantime, each of the protuberances 53 also abuts against the respective barrier wall 172 to be non-rotatably retained in the concavity 150.

Additionally, when each protuberance 53 abuts against the corresponding rest wall 16, the press surface 32 of the abutment member 3 abuts against the mounting end 51 of the tubular insert 5 and the protuberances 53. Therefore, the engagement between the tubular insert 5 and the anchored mount 1 is firm and stable. It should be noted that the abutment member 3 may be integrally formed with the tubular insert 5 and coplanar with the protuberances 53 so as to be inserted into the insert opening 18 together with the tubular insert 5.

When it is desired to replace the elastic cord 300, the mounting end 51 of the tubular insert 5 is pushed manually against the biasing force of the biasing member 4 such that each protuberance 53 is freed from the respective concavity 150 and extends beyond the respective seat 15. Subsequently, each protuberance 53 is turned angularly over the respective seat 15 to enter the respective inserting route 14. By the biasing force of the biasing member 4, the tubular insert 5 can be easily removed from the anchored mount 1 through the inserting routes 14.

It should be noted that the arrangement of the inserting routes 14, the seats 15, the concavities 150, and the rest walls 16 maybe modified, and the direction that each of the protuberances 53 is turned over the respective seat 15 may also be varied accordingly.

Figure 9:
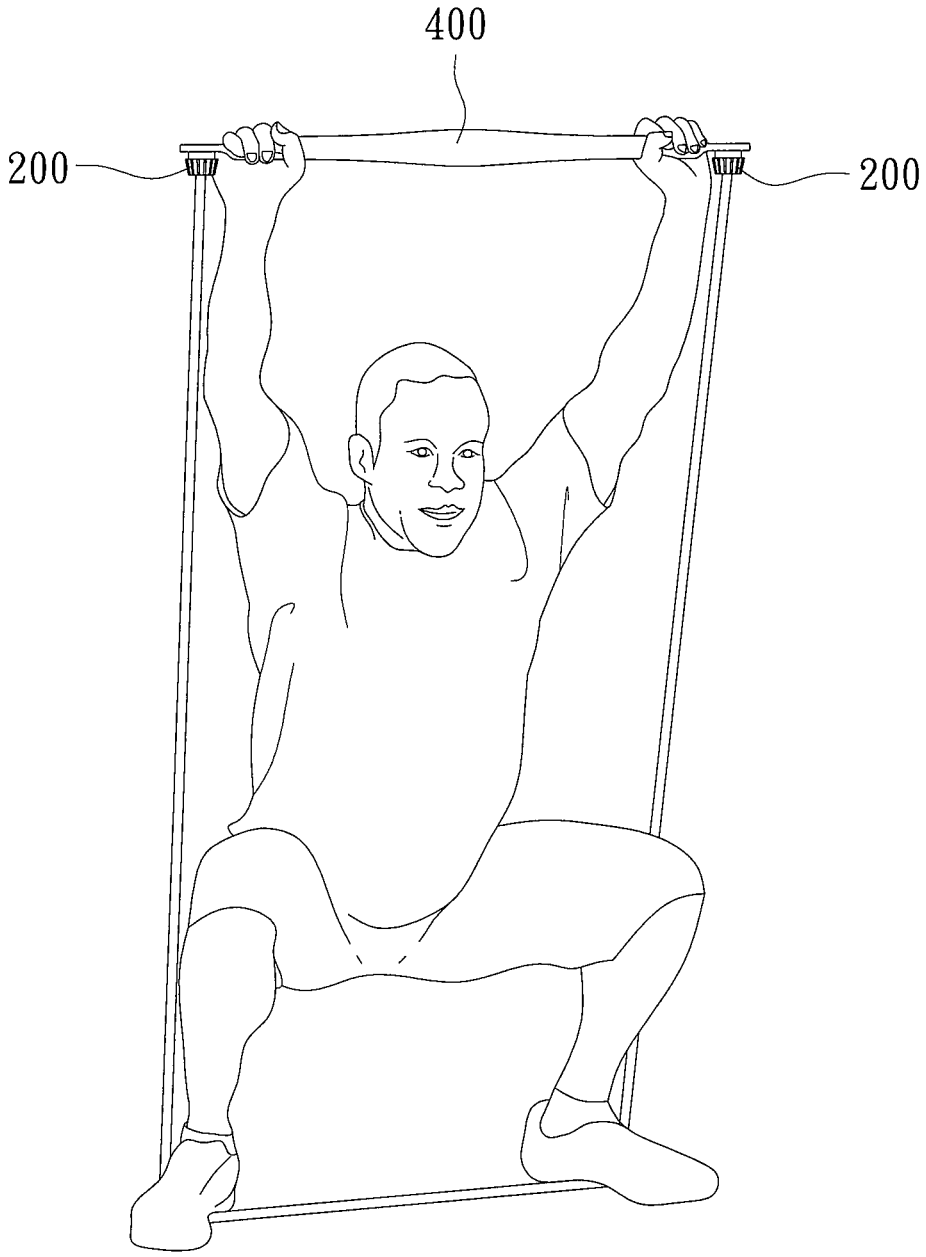
FIG. 9 is a schematic view of the exercise-cord anchored device of a second preferred embodiment according to the present invention.

Referring to FIG. 9, a second preferred embodiment of the exercise-cord anchored device 200 according to the present invention has a structure similar to that of the first embodiment. The main difference between this embodiment and the first embodiment resides in that the exercise-cord anchored device 200 further comprises a transverse rod 400 extending in a direction transverse to the lengthwise direction (X) for operation by a user, and two of the anchored mounts 1 are disposed on opposite ends of the transverse rod 400.

Figure 10:
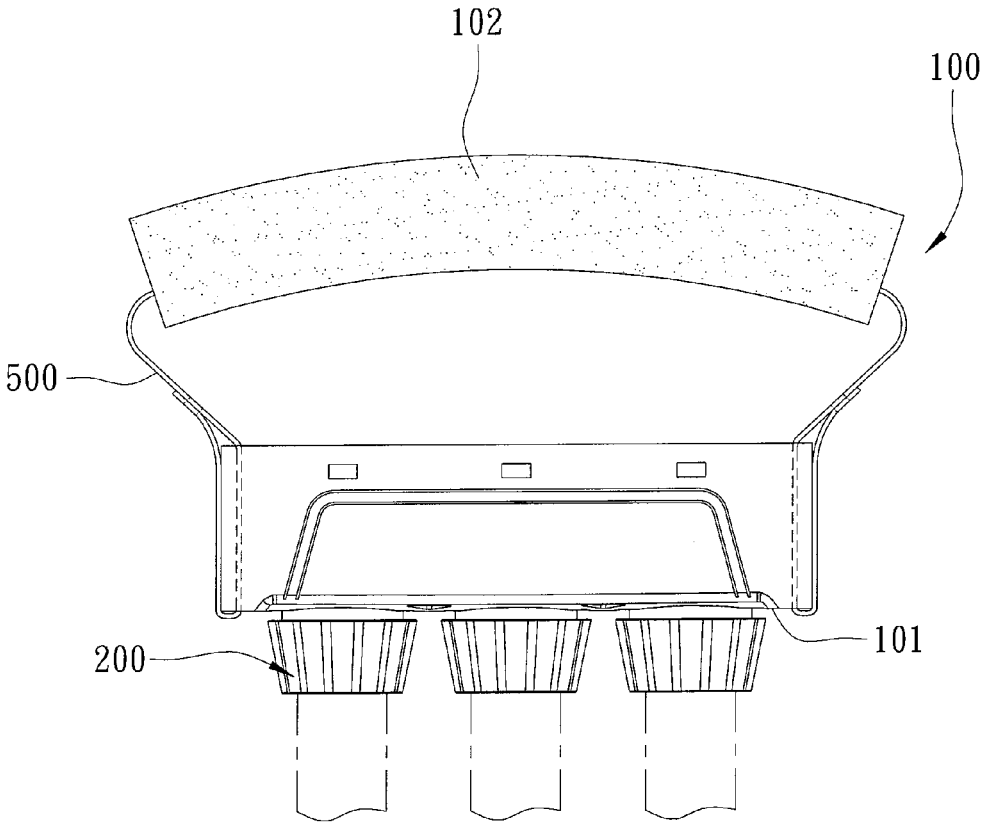
FIG. 10 is a schematic side view of the exercise-cord anchored device of a third preferred embodiment according to the present invention.

Referring to FIG. 10, a third preferred embodiment of the exercise-cord anchored device according to the present invention has a structure similar to that of the first embodiment. In the third embodiment, the exercise-cord anchored device further comprises a connector 500 interconnecting the grasp portion 102 and the mounting portion 101 of the grasp member 100. The grasp portion 102 is made of foam or plastic material, and the connector 500 includes webbing strips.

Figure 11:
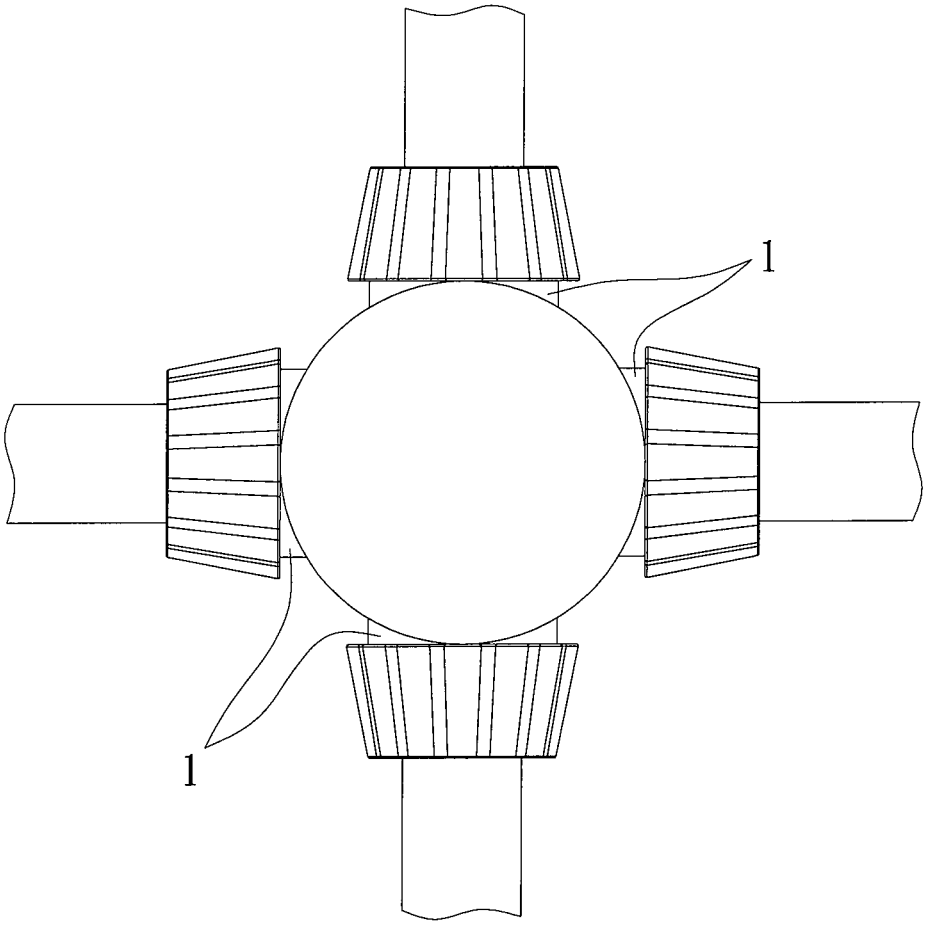
FIG. 11 is a schematic elevation view of the exercise-cord anchored device of a fourth preferred embodiment according to the present invention.

Referring to FIG. 11, a fourth preferred embodiment of the exercise-cord anchored device according to the present invention has a structure similar to that of the first embodiment, except that the number of the anchored mounts 1 is four, and that the anchored mounts 1 are disposed to be angularly displaced from one another about a mounting axis.

Figure 12:
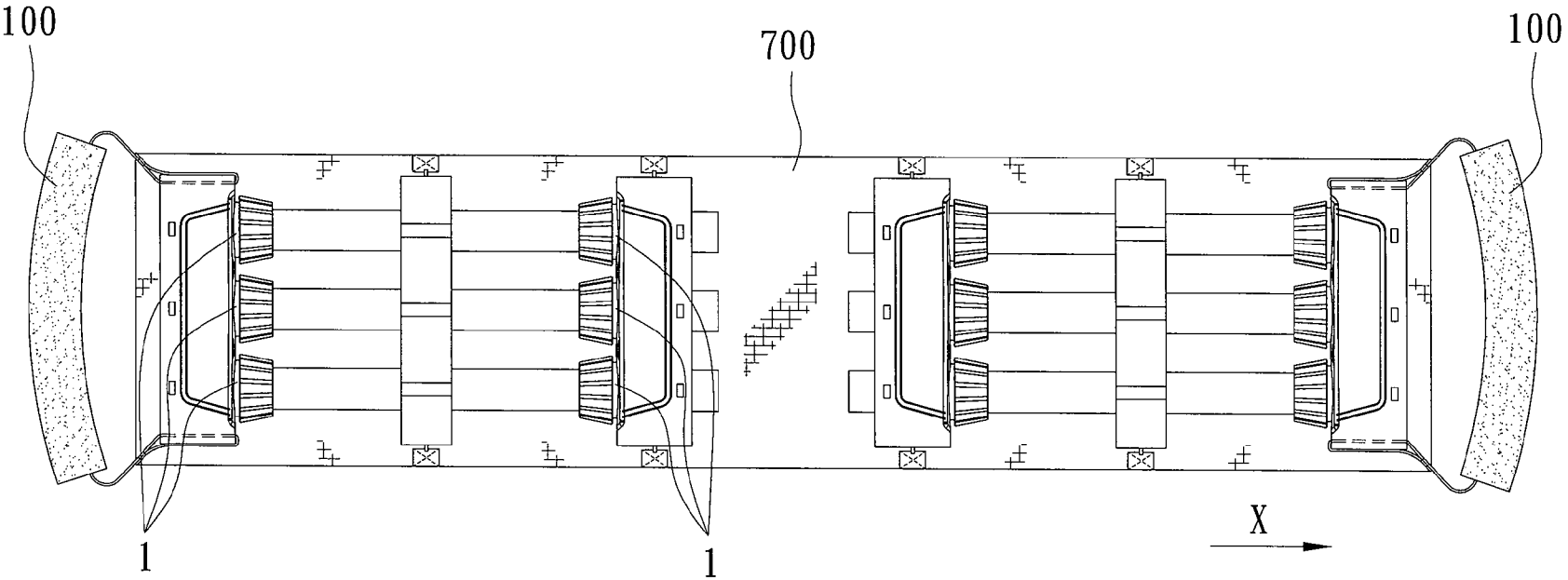
FIG. 12 is a schematic elevation view of the exercise-cord anchored device of a fifth preferred embodiment according to the present invention.
Figure 13:
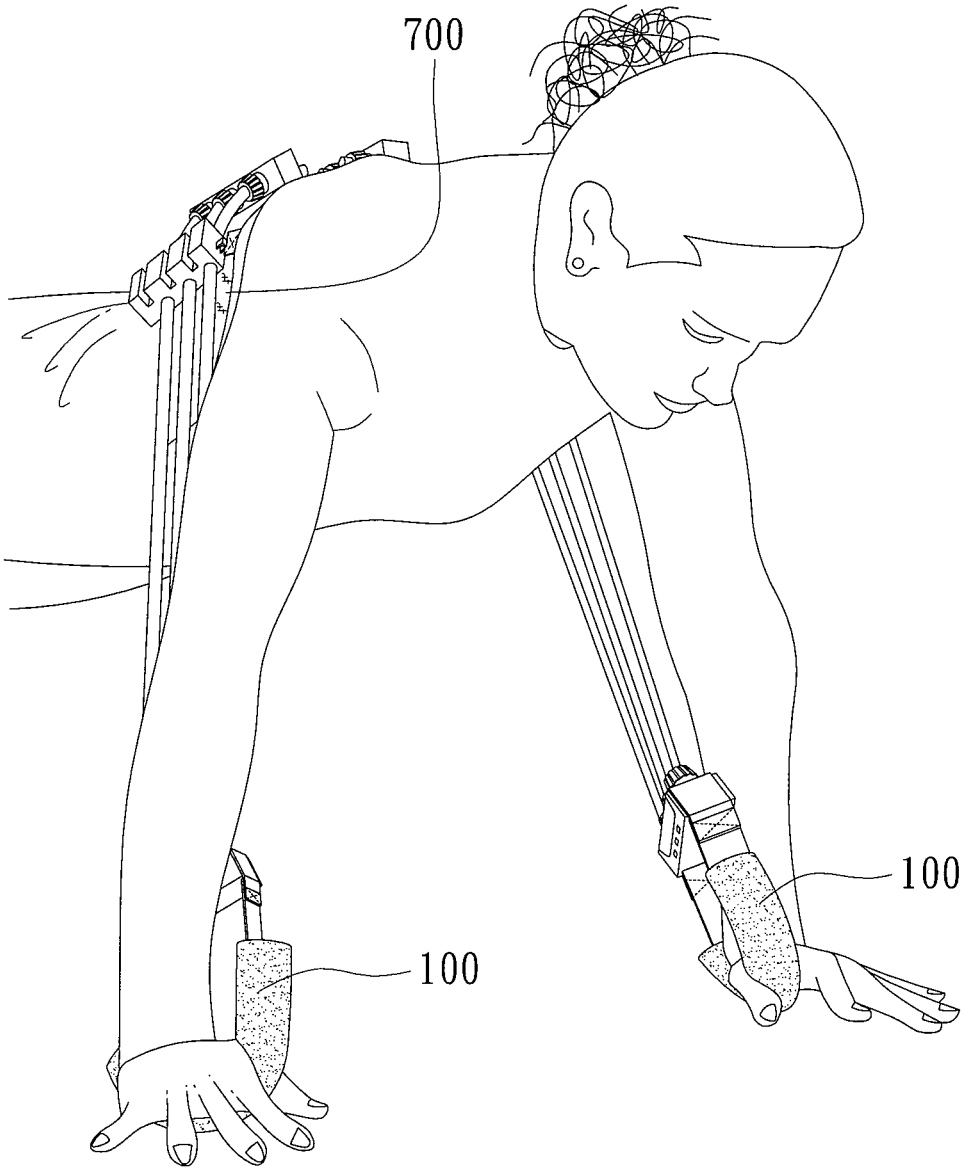
FIG. 13 is a schematic perspective view of the fifth preferred embodiment used as an auxiliary device for doing push-ups.

Referring to FIGS. 12 and 13, a fifth preferred embodiment of the exercise-cord anchored device 200 according to the present invention has a structure similar to that of the first embodiment. In the fifth embodiment, the exercise-cord anchored device 200 comprises four rows of the anchored mounts 1, an elastic webbing 700, and two grasp members 100 connected to opposite ends of the elastic webbing 700 in the lengthwise direction (X). Each row of the anchored mounts 1 includes three anchored mounts 1 and is in series connection to an adjacent row of the anchored mounts 1. The exercise-cord anchored device 200 of this embodiment can be used as an auxiliary device for doing push-ups.

Figure 14:
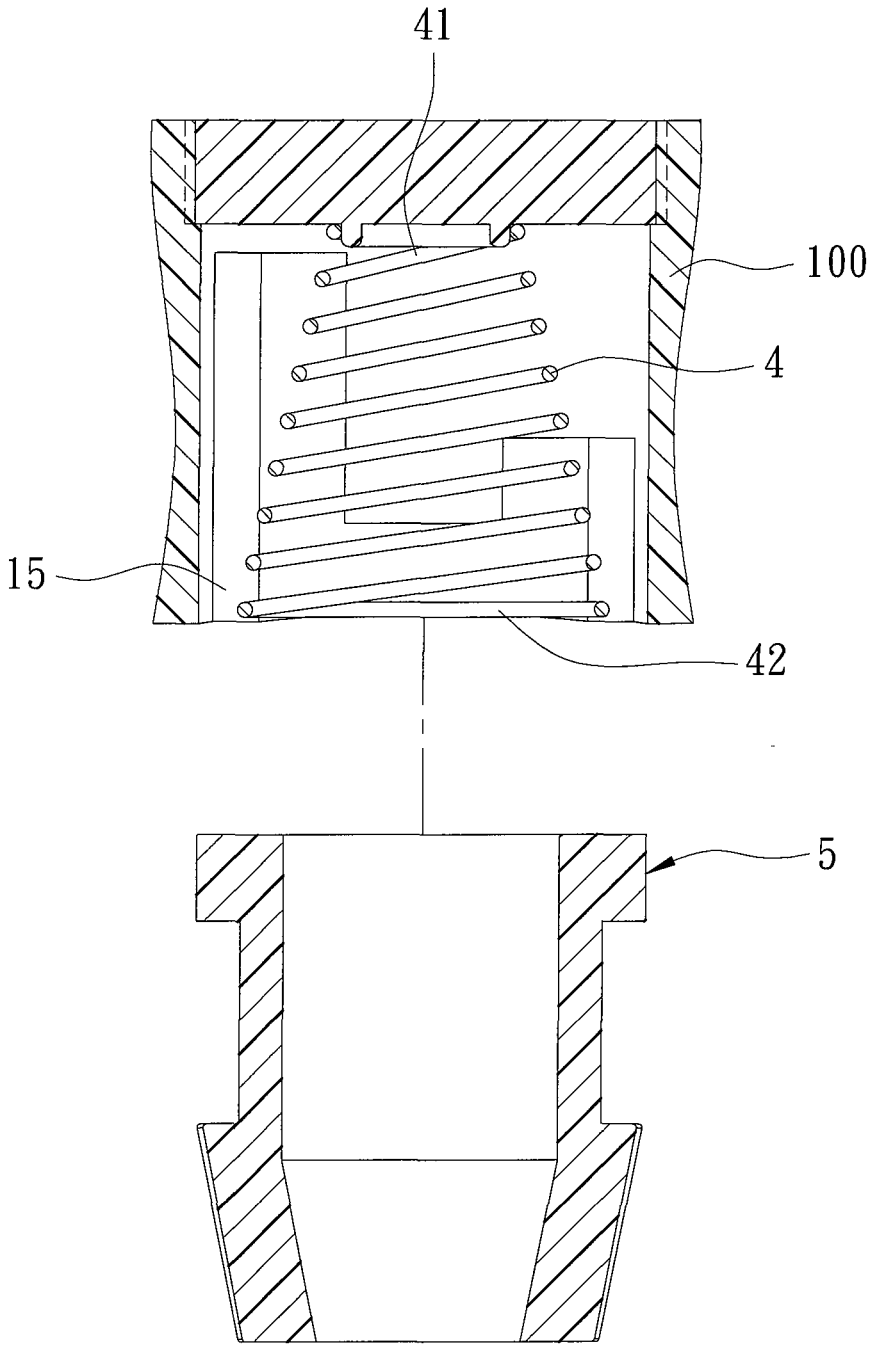
FIG. 14 is a fragmentary exploded sectional view of the exercise-cord anchored device of a sixth preferred embodiment according to the present invention.

Referring to FIG. 14, a sixth preferred embodiment of the exercise-cord anchored device 200 according to the present invention has a structure similar to that of the first embodiment. The main difference between this embodiment and the first embodiment resides in the following. In the sixth embodiment, the abutment member 3 as illustrated in the first embodiment is omitted. The biasing member 4 has a dimension gradually increased from the connected end 41 to the urging end 42. The urging end 42 of the biasing member 4 is in pressing engagement with the seats 15 when the biasing member 4 is in the fully extended position and is biased to abut against the mounting end 51 of the tubular insert 5.

While the present invention has been described in connection with what are considered the most practical and preferred embodiments, it is understood that this invention is not limited to the disclosed embodiments but is intended to cover various arrangements included within the spirit and scope of the broadest interpretations and equivalent arrangements.

What is claimed is:

1. An exercise-cord anchored device adapted for detachably securing thereto an anchoring end of an elastic cord, comprising:

an anchored mount having upper and lower surfaces which are opposite to each other in a lengthwise direction an inner tubular wall which extends from said lower surface along an axis oriented in the lengthwise direction toward said upper surface and which defines an insert opening, an inserting route which is disposed on said inner tubular wall and which extends in the lengthwise direction from said lower surface toward said upper surface, a seat which is disposed on said inner tubular wall and behind said inserting route in a clockwise direction, and a rest wall which is disposed on said inner tubular wall and behind said seat in the clockwise direction, and which is disposed inwardly from said seat relative to said upper surface so as to cooperate with said seat to define a concavaity;

a biasing member disposed in said insert opening and having a connected end secured relative to said upper surface, and an urging end disposed to be movable between a partially extended position where said urging end is closer to said upper surface, and a fully extended position where said urging end is biased against said seat with a biasing force;

a tubular insert adapted to couple with the anchoring end of the elastic cord, having a mounting end which is configured to be insertable into said insert opening so as to permit said tubular insert to be manually moved toward said upper surface against the biasing force to as to displace said urging end to the partially extended position, and a protuberance disposed on said mounting end of said tubular insert, and configured such that, by virtue of guiding said protuberance a long said inserting route, said mounting end is pushed manually against the biasing force, and such that, once said protuberance is brought to extend beyond said seat by virtue of displacing said urging end to the partially extended position, said protuberance is turned angularly over said seat so as to be snapped into said concavity, thereby abutting against said rest wall; and an abutment member which is disposed in and movable relative to said insert opening in the lengthwise direction between proximate and distal positions relative to said lower surface that correspond to the fully and partially extended positions, and which has an urged surface biased by said urging end of said biasing member, and a press surface disposed to abut against said seat when said abutment member is at the proximate position;

wherein said insert opening extends through said upper surface, said exercise-cord anchored device further comprising an end cap disposed to be engaged with said upper surface to cover said insert opening, and having a positioning protuberance that is formed on a bottom surface thereof and that engages said connected end of said biasing member, said abutment member further having a positioning protrusion formed on said urged surface for engaging said urging end of said biasing member.

2. The exercise-cord anchored device according to claim 1, wherein said anchored mount has a guideway which is disposed on said inner tubular wall and which extends in the lengthwise direction to terminate at the proximate and distal positions, said abutment member being configured to be guided by said guidway to non-rotatably move between the proximate and distal positions.

3. The exercise-cord anchored device according to claim 2, wherein said abutment member is configured to abut against said mounting end of said tubular insert and said protuberance when said protuberance abuts against said rest wall.

4. The exercise-cord anchored device according to claim 3, wherein said abutment member has a notch portion formed along a periphery of said abutment member and extending through said urged and press surfaces so as to be guided by said guideway to non-rotatably moved between the proximate and distal positions, said anchored mount having a barrier wall disposed on said inner tubular wall and extending from said lower surface toward said guideway and behind said rest wall in the clockwise direction such that, when said protuberance is snapped into concavity and abuts against said rest wall, said protuberance abuts against said barrier wall so as to be non-rotatably retained in said concavity.

5. The exercise-cord anchored device according to claim 1, wherein said anchored mount is formed with a notch adjacent to said upper surface, said end cap being formed with a projection disposed outwardly and radially of a periphery thereof for engaging said notch.

6. The exercise-cord anchored device according to claim 1, wherein said tubular insert has a flange spaced apart from said mounting end in the lengthwise direction and having an outer diameter larger than that of said inner tubular wall so as to abut against said lower surface when said protuberance is bought to extend beyond said seat.

7. The exercise-cored anchored device according to claim 1, wherein said biasing member is a coil spring, and has a dimension gradually increased from said connected end to said urging end.

8. The exercise-cord anchored device according to claim 1, further comprising a transverse rod extending in a direction transverse to the lengthwise direction, two of said anchored mounts being disposed on opposite ends of said transverse rod.

9. The exercise-cord anchored device according to claim 1, further comprising a grasp member having a grasp portion disposed to be spaced apart from said anchored mount in the lengthwise direction and a mounting portion disposed for mounting said anchored mount, and a connector interconnecting said grasp portion and said mounting portion.

10. An exercise-cord anchored assembly adapted for detachably securing thereto a plurality of anchoring ends of elastic cords, comprising:

a plurality of anchored mounts angularly displaced from one another about a mounting axis, each having upper and lower surfaces which are opposite to each other in a lengthwise direction that is transverse to the mounting axis, an inner tubular wall which extends from said lower surface along an axis oriented in the lengthwise direction toward said upper surface and which defines an insert opening, an inserting route which is disposed on said inner tubular wall and which extends in the lengthwise direction from said lower surface toward said upper surface, a seat which is disposed on said inner tubular wall and behind said inserting route in a clockwise direction, and a rest wall which is disposed on said inner tubular wall and behind said seat in the clockwise direction, and which is disposed inwardly from said seat relative to said upper surface so as to cooperate with said seat to define a concavity;

a plurality of biasing members each disposed in said insert opening of a respective one of said anchored mounts and having a connected end secured relative to said upper surface of the respective one of said anchored mounts, and an urging end disposed to be movable between a partially extended position where said urging end is closer to said upper surface of the respective one of said anchored mounts, and a fully extended position where said urging end is biased against said seat of the respective one of said anchored mounts with a biasing force;

a plurality of tubular inserts adapted to couple respectively with the anchoring ends of the elastic cords, each of said tubular inserts having a mounting end which is configured to be insertable into said insert openings of a respective one of said anchored mounts so as to permit said tubular insert to be manually moved toward said upper surfaces of the respective one of said anchored mounts against the biasing force so as to displace said urging end to the partially extended position, and a protuberance disposed on said mounting end of said tubular insert, and configured such that, by virtue of guiding said protuberance along said inserting route of the respective one of said anchored mounts, said mounting end is pushed manually against the biasing force, and such that, once said protuberance is brought to extend beyond said seat of the respective one of said anchored mounts by virtue of displacing said urging end to the partially extended position, said protuberance is turned angularly over said seat of the respective one of said anchored mounts so as to be snapped into a corresponding one of said concavity, thereby abutting against said rest wall of the respective one of said anchored mounts, and a plurality of abutment members, each of which is disposed in and movable relative to said insert opening of a respective one of said anchored mounts in the lengthwise direction between proximate and distal positions relative to said lower surface of the respective one of said anchored mounts that correspond to the fully and partially extended positions, and each of which has an urged surface biased by said urging end of a respective one of said biasing members, and a press surface disposed to abut against said seat of the respective one of said anchored mounts when said abutment member is at the proximate position;

wherein said insert opening of each of said anchored mounts extends through said upper surface of the respective one of said anchored mounts, said exercise-cord anchored assembly further comprising a plurality of end caps each disposed to be engaged with said upper surface of a respective one of said anchored mounts to cover said insert opening of the respective one of said anchored mounts, and having a positioning protuberance that is formed on a bottom surface thereof and that engages said connected end of a respective one of said biasing members, each of said abutment members further having a positioning protrusion formed on said urged surface for engaging said urging end of a respective one of said biasing members.

* * * * *